US007131307B2

(12) United States Patent
Koppinen et al.

(10) Patent No.: US 7,131,307 B2
(45) Date of Patent: Nov. 7, 2006

(54) COMPACT ROLLING MILL AND A METHOD OF PRODUCING A THIN STRIP

(75) Inventors: Ilpo Koppinen, Delaware, OH (US); Brian Swank, Marengo, OH (US); Hans Keife, Västerås (SE)

(73) Assignee: Outokumpu Oyj (FI)

( * ) Notice: Subject to any disclaimer, the term of this patent is extended or adjusted under 35 U.S.C. 154(b) by 0 days.

(21) Appl. No.: 10/870,210

(22) Filed: Jun. 17, 2004

(65) Prior Publication Data

US 2005/0279148 A1 Dec. 22, 2005

(51) Int. Cl.
*B21B 29/00* (2006.01)

(52) U.S. Cl. ..... 72/243.6; 72/241.2; 72/252.5

(58) Field of Classification Search ..... 72/243.6, 72/241.1, 242.4, 248, 252.5
See application file for complete search history.

(56) References Cited

U.S. PATENT DOCUMENTS 1,908,269 A * 5/1933 Palmgren ..... 72/237
3,593,556 A * 7/1971 Blain ..... 72/243.6
2001/0018840 A1 9/2001 Nihei et al. ..... 72/243.4
2003/0167818 A1 9/2003 Kato et al. ..... 72/251

FOREIGN PATENT DOCUMENTS

SU 0772617 * 10/1980

* cited by examiner

*Primary Examiner*—Derris H. Banks
*Assistant Examiner*—Teresa M Bonk
(74) *Attorney, Agent, or Firm*—Morgan & Finnegan, LLP

(57) ABSTRACT

The invention relates to an apparatus for rolling a strip (21) comprising a first work roll (24), which is mounted from both ends with bearings (35) to the mill frame, a second work roll (25), which work rolls (24, 25) are forming a nip (26) in between them, one or more ring(s) (19, 20) closing inside at least one of the work rolls (24, 25), at least first intermediate roll (27, 39) mounted to the mill frame from both ends with bearings (36) and arranged in rolling contact between the second work roll (25) and inside surface (22) of the ring(s) (19, 20). The invention also relates to the method of producing a thin strip.

18 Claims, 5 Drawing Sheets

PRIOR ART
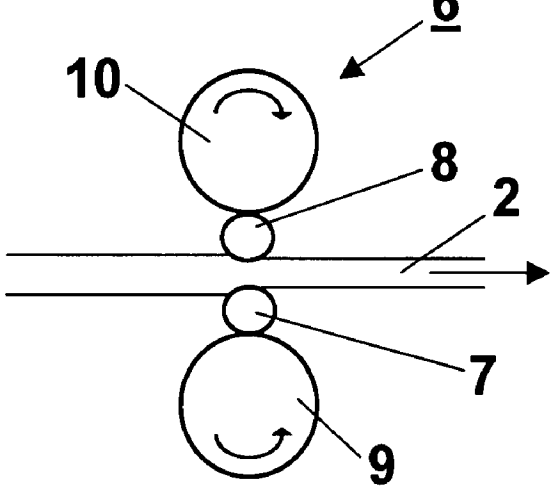
Fig. 1a
PRIOR ART
Fig. 1b
PRIOR ART
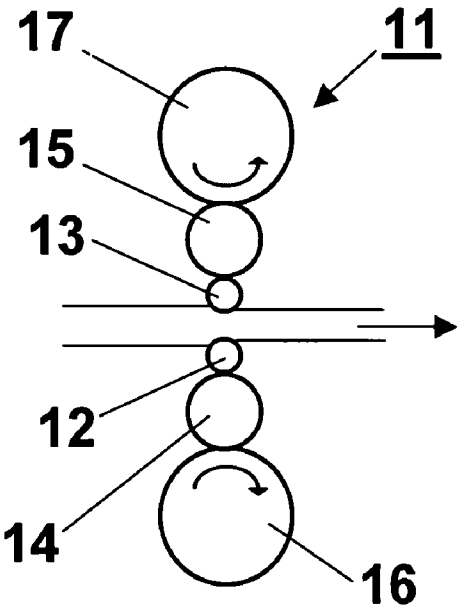
Fig. 1c

COMPACT ROLLING MILL AND A METHOD OF PRODUCING A THIN STRIP

BACKGROUND OF THE INVENTION

This invention relates in general to mills for rolling metal products such as strands and strips. More specifically, it relates to an apparatus of compact size for rolling a narrow strip and a method of producing a thin strip.

Rolling mills are used for reducing the thickness of metal strips. The simplest rolling mill is constructed with two large and heavy work rolls rotating in opposite directions and forming a nip in between. The mill is called 2-high mill. The term "nip" is used herein to refer to the region where the rolls are closest together. The high forces associated with the rolling are guided to the work rolls bearings, which therefore have to be strong, that are heavily build. For rolling thin strips it is for contrary necessary to use work rolls with small diameter. However, with small rolls there is not enough space for strong bearings, which are required due high rolling forces. This had led to various roll arrangements in rolling mills for thin strips.

For rolling thin strips the arrangements conventionally comprises two small diameter work rolls and several support rolls, which are carrying the rolling forces and directing them through the bearings to the rolling mill frame. Usually the work rolls are at least supported by backup rolls and sometimes with a system of intermediate rolls and backup rolls. The system comprising two work rolls and two backup rolls is the most common arrangement for rolling thin strips. It is called 4-high construction. The work rolls of such construction are kept in place with small bearings whereas the rolling force is carried by support/backup rolls fitted to big heavy-duty bearings in mill frame.

4-high rolling mills are quite useful for producing the thin strip but the problem is that the heavy backup rolls are requiring a big and solid frame. The overall size of the frame of such rolling mill can be 2 to 3 meters high. The main disadvantage of such mills is that also for narrow strips the rolling mill becomes big and expensive.

Above described rolling mills are disclosed for example in following documents. US 2003/0167818 A1 discloses a hot rolling mill where a thin steel strip is passed through work rolls, which are supported by backing rolls. The construction is typical 4-high rolling mill. Such a 4-high rolling mill constructions is disclosed also in US 2002/0043358 A1.

In US 2001/0018840 are disclosed a construction with small work rolls, bigger intermediate rolls and large backup rolls. With such construction the size of the frame becomes even bigger than with 4-high rolling mill.

SUMMARY OF THE INVENTION

The object of this invention is to provide an apparatus having a compact and low cost construction and also a new method for rolling a thin strip. Another object of this invention is to produce an apparatus and method for an easy adjustment of the gap in the nip.

The essential features and advantageous embodiments of the present invention are described herein. The apparatus and the method are suitable especially for producing a narrow strip.

BRIEF DESCRIPTION OF THE DRAWINGS

The invention is described in more details referring to following drawings, where FIG. 1*a* to 1*c* are simplified pictures of three prior art rolling mills.

DETAILED DESCRIPTION OF THE PREFERRED EMBODIMENTS

Figure 2:
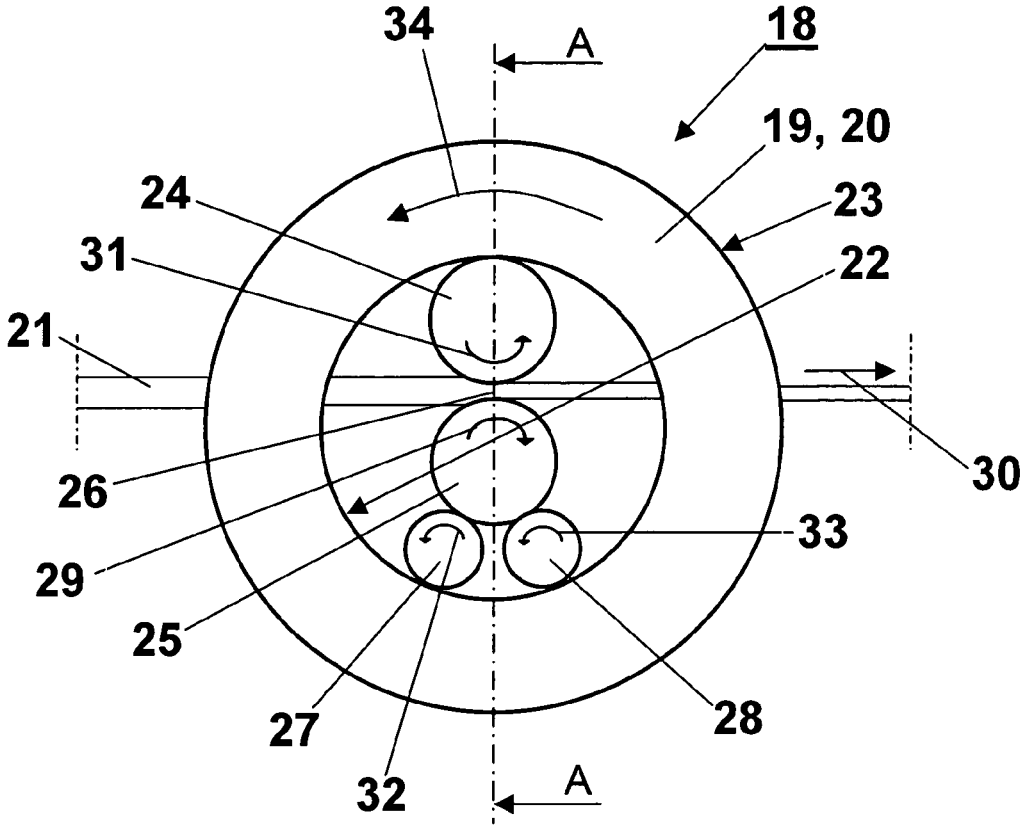
FIG. 2 is a schematic side view presentation of the main components of the rolling mill according to the first embodiment of the invention.

In FIG. 1*a* to 1*c* are presented three prior art configurations of the rolling mill. In FIG. 1*a* is a simple 2-high mill 1, where the strip 2 is guided directly to the nip 3 of two massive work rolls 4 and 5. This configuration is not suitable for rolling a thin strip since for rolling a thin strip two small work rolls are needed. The work rolls 4 and 5 are connected to the mill frame with strong roll bearings. The bearings and the mill frame are not shown in the FIG. 1*a*.

In FIG. 1*b* is the most common arrangement, which is called a 4-high mill 6. There the smaller work rolls 7 and 8 transfer the rolling forces to the support/backup rolls 9 and 10, which again are connected to the mill frame with strong roll bearings. This configuration is suitable for rolling a thin strip 2, but the mill frame is still very massive as it was also with 2-high mill 1.

In FIG. 1*c* is a third arrangement 11 with two small work rolls 12 and 13, two bigger intermediate rolls 14 and 15 and two big support/backup rolls 16 and 17.

The bearings with the small work rolls 12 and 13 can be made lighter as also in with the 4-high mill 6 but nevertheless the big support/backup rolls 16 and 17 need to be connected to the mill frame with strong roll bearings. This arrangement 11 needs also very massive mill frame.

The requirement for strong bearings in all three prior art solutions 1, 6 and 11 dictate the size of the overall construction and are making the mill frame very massive in all solutions.

In FIG. 2 is a schematic side view presentation of the main components of the rolling mill 18 according to the first embodiment of the invention. The apparatus comprises two rings 19 and 20, which are arranged parallel to each other and each on opposite sides of the strip 21. In this view the second ring 20 is positioned behind the first ring 19 and cannot be seen. In this embodiment the inner surface 22 and the outer surface 23 of the rings 19 and 20 are essentially flat and parallel to the rolling axes of the rings. Inside the rings 19 and 20 are arranged a first work rolls 24, which is in rolling contact with the inner surfaces 22 of the rings 19 and 20 and mounted to the mill frame from both ends with bearings (not shown). A second work roll 25 is arranged inside the rings 19 and 20 to form a nip 26 between the work rolls 24 and 25, where the actual rolling of the strip 21 is done. The actual length of the second work 25 roll does not actually have to extend inside the rings 19 and 20. It is enough that the imaginary extension of the work roll 25 does it. The second work roll 25 is in that case situated between the two rings 19 and 20. Further inside the rings 19 and 20 are arranged first and second intermediate rolls 27 and 28. The purpose of these intermediate rolls 27 and 28 is to change the rolling direction 29 of the second work roll 25 and on the other hand made possible to adjust the gap in the nip 26. The adjustment of the gap in the nip 26 is explained in more details later on in FIG. 6.

The inner surfaces 22 of the rings 19 and 20 can alternatively be made slightly concave and the surfaces of the rolls 24, 25, 27 and 28 can be also contoured to match the inner surfaces 22. The reason is that there might be a need to skew the mill 18 a little to get the strip 21 straight and to keep the strip from moving sideways.

When the strip is moving to the direction of the arrow 30 the first work roll 24 is rotating according arrow 31, lower work roll 25 according to arrow 29, the intermediate rolls 27 and 28 are rotating according to arrows 32 and 33 and the rings 19 and 20 are rotating according to the arrow 34. The rings 19 and 20 that are surrounding the rolls 24, 25, 27 and 28 give them strong support and therefore the bearings with the rolls are not massive as in all prior art solutions presented in FIG. 1.

Figure 3:
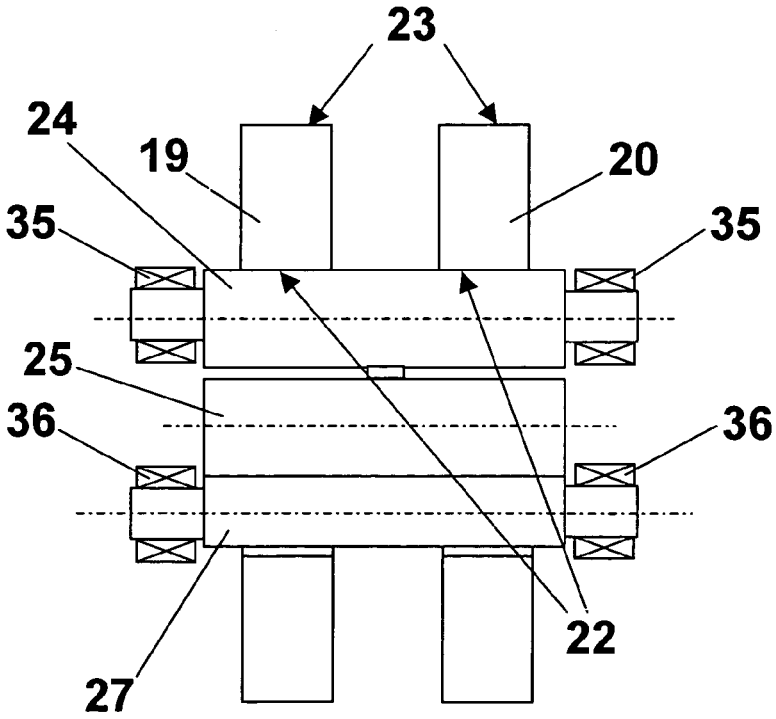
FIG. 3 is a cross-sectional view according to line A—A from FIG. 2 of the first embodiment.

In FIG. 3, which is a cross-section along line A—A from FIG. 2, the surrounding rings 19 and 20 are forming four rectangular cross-sectional areas in the top and bottom of the drawing due the parallel inner and outer surfaces 22 and 23 of the rings in relation with the rolling axes of the rings. The cross-sectional area of the rings 19 and 20 can be anything. The only limiting factor is the inner surface 22 of the rings 19 and 20, which must be essentially flat (but not even parallel to the rolling axes of the rings as is explained later). The first work roll 24, which penetrates through both rings 19 and 20, has bearings 35 in both ends. The bearings 35 are mounted in the support structure (the mill frame), which is not shown in the drawing. At the same way the two intermediate rolls 27 and 28 are fitted with bearings 36 to the support structure. The second work roll 25 is rotating freely and supported by the two intermediate rolls 27 and 28 and has no bearings in its ends. The second work roll 25 can be made also shorter so that it is not reaching the insides of the rings 19 or 20 but is situated in between them. The contact between the rings 19 and 20 and the first work roll 24 together with the contact between the rings 19 and 20 and two intermediate rolls 27 and 28 are keeping the assembly together. Thus the rings 19 and 20 are taking the large amount of the rolling forces the bearings 35 and 36 associated with the first work roll 24 and intermediate rolls 27 and 28 can be made very light. This reduces the size of the whole rolling mill arrangement 18 significantly.

The arrangement in the rolling mill 18 can be made also with only one ring 19 or 20 situated in the middle of the rolling mill. With this construction it is possible to roll one or two strips 21 at the same time in one mill 18. In case of two strips the strips are situated to the opposite sides of the ring 19 or 20.

Figure 4:
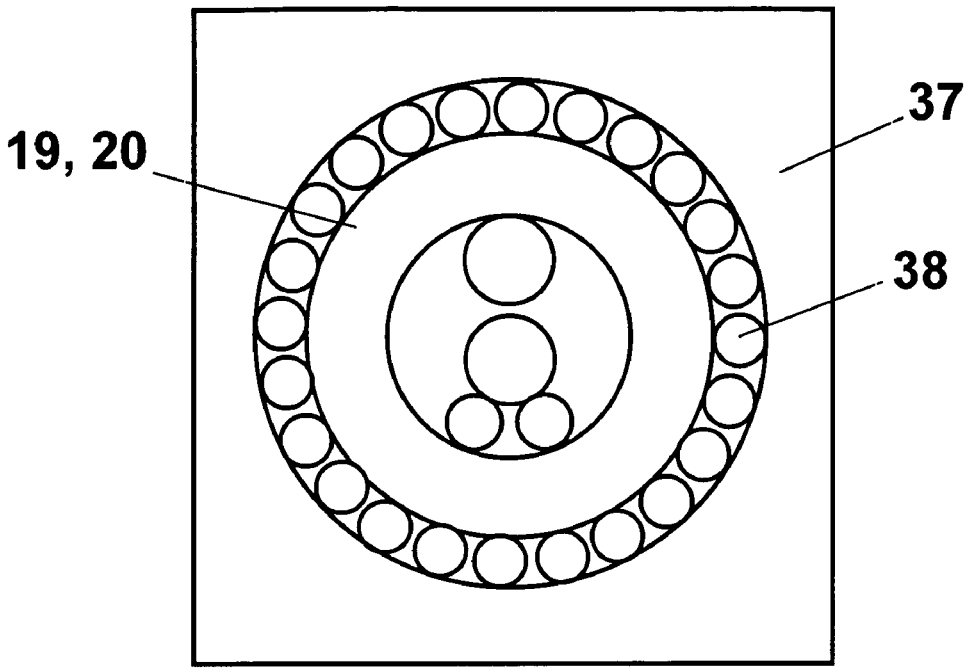
FIG. 4 is a schematic side view presentation of the main components of the rolling mill according to the second embodiment of the invention.

In FIG. 4 is another embodiment of the present invention. If the rolling movements of the rings 19 and 20 are wanted to be eliminated for some reason, the rings can be arranged inside a stationary frame 37. Between the frame 37 and rings 19 and 20 (ring 20 behind ring 19) are arranged a number of bearing rolls 38. With this arrangement the rolling movement of the rings 19 and 20 can be covered and the frame 37 is maintained stationary. The outer design of the frame 37 can be whatever the manufacturer decides. Here the frame 37 is presented in rectangular form. Also the bearing assembly can be any conventional bearing assembly.

Figure 5:
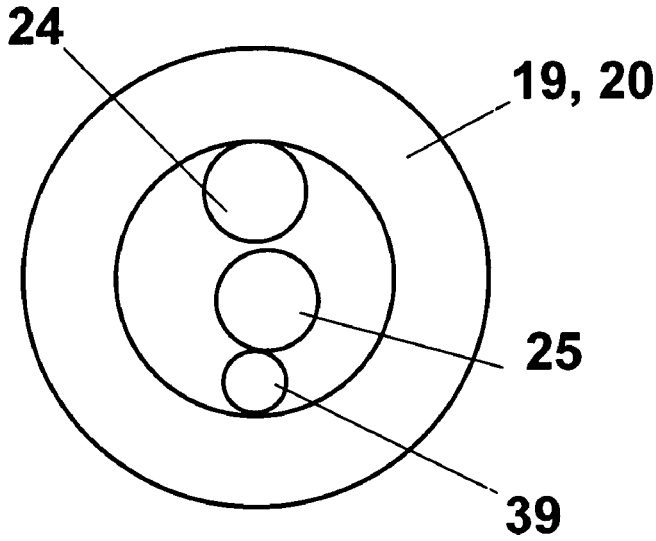
FIG. 5 is a schematic side view presentation of the main components of the rolling mill according to the third embodiment of the invention.

In FIG. 5 is presented another embodiment of arranging the work rolls 24 and 25 inside the rings 19 and 20. In this embodiment only one intermediate roll 39 is arranged between the second work roll 25 and the rings 19 and 20 to change the rolling direction of the work roll and to support the work roll. In this embodiment the second work roll 25 is also mounted to the mill frame with bearings.

Figure 6:
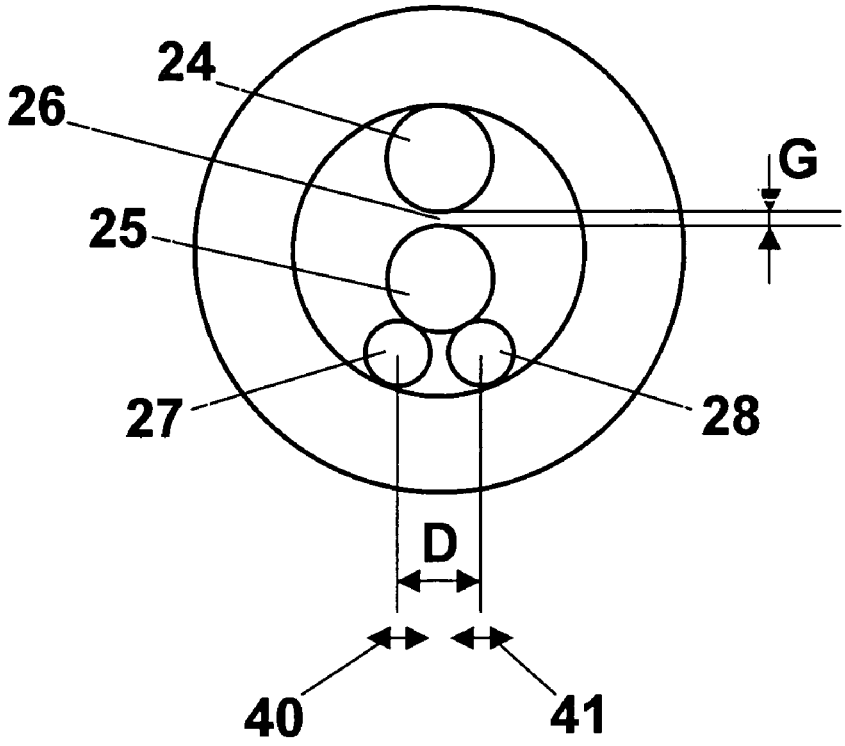
FIGS. 6 to 8 are schematic side view presentations of the adjustment of the gap in the nip of the rolling mill according to the invention.

It is important to be able to adjust the gap G in the nip 26 for variations in the strip thickness. This is achieved for embodiment presented in FIG. 3 with movement of the intermediate rolls 27 and 28 as illustrated in FIG. 6 with arrows 40 and 41. If the distance D between the rolls 27 and 28 is enlarged the second work roll 25 can move further from the first work roll 24 and the gap G in the nip 26 is increased. On the other hand, when the distance D between the intermediate rolls 27 and 28 is reduced the second work roll 25 is forced to move towards the first work roll 24 and the gap G in the nip 26 is diminished. The variation in the distance D can be achieved by moving either one of the intermediate rolls 27 and 28 or both of them. Another possibility is to move both intermediate rolls 27 and 28 to the same direction and maintain their distance D constant to achieve the same effect to the gap G in the nip 26. Also the adjustment of the gap G can be done with a combination of any of these methods.

Figure 7:
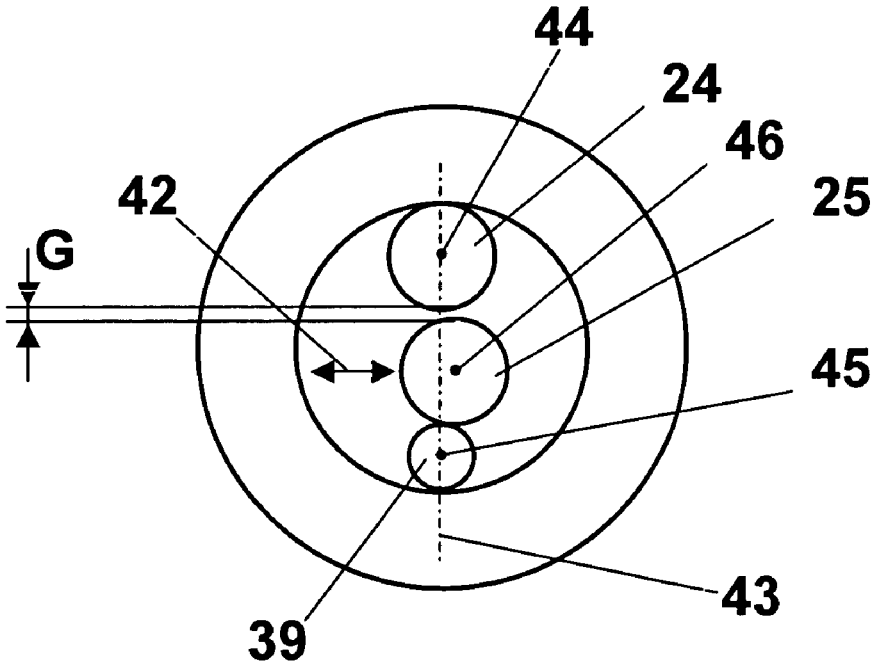

In FIG. 7 is illustrated the control of the gap G for the embodiment presented in FIG. 5. The second work roll 25 can be moved according the arrow 42 in relation to the line 43, which is drawn between the rolling axes 44 and 45 of the first work roll 24 and the intermediate roll 39. Moving the second work rolls 25 rolling axis 46 further from the line 43 the gap G in the nip 26 is increased and when moved towards the line the gap in the nip is diminished. The same effect can be achieved with the movement of the intermediate roll 39 as well. In this case the reference line is drawn between the rolling axes 44 and 46 of the first work roll and the second work roll.

Figure 8:
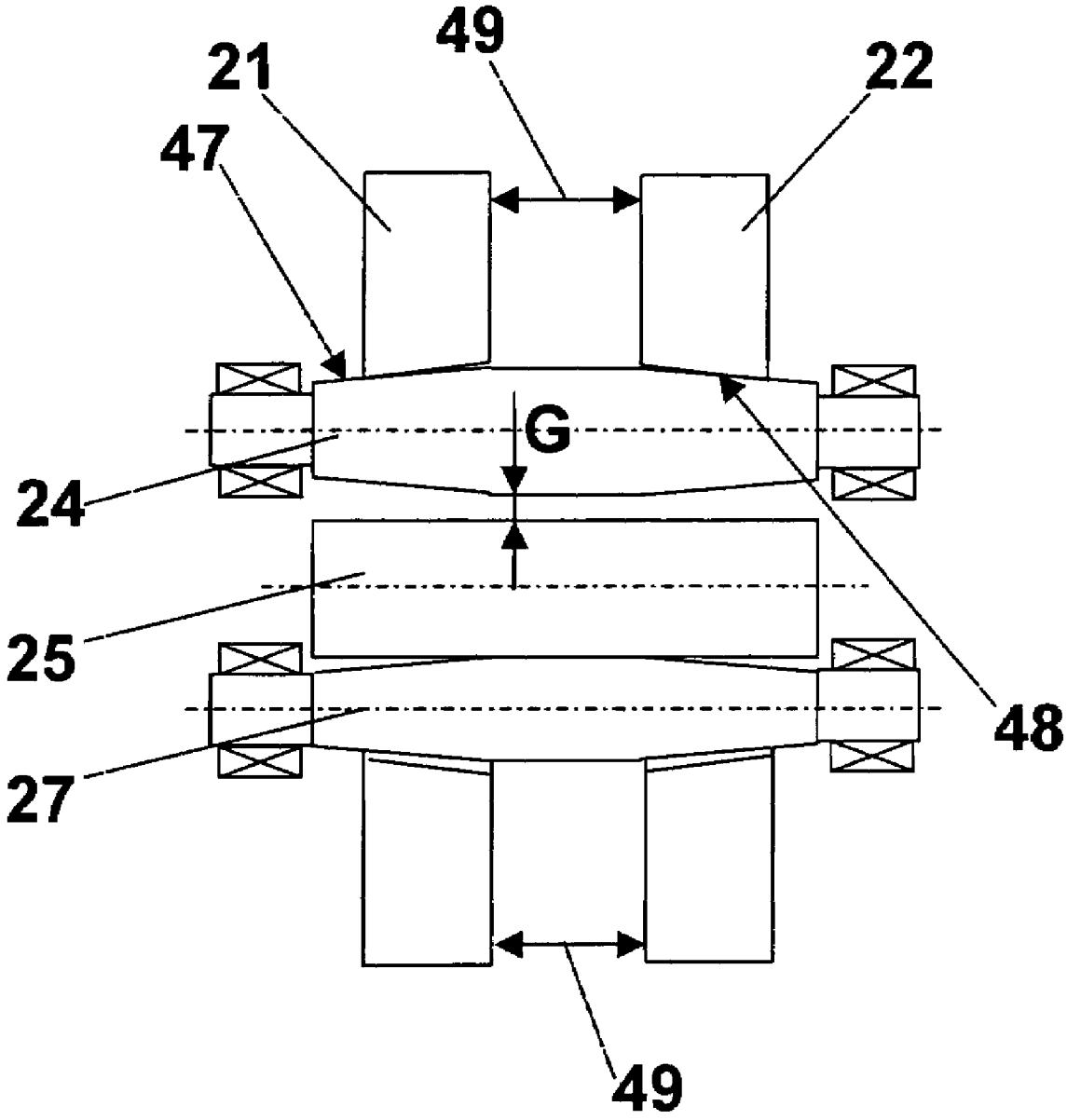

In FIG. 8 is presented an alternative solution for the control of the gap G. This solution is suitable to all presented embodiments of the rolling mills. The ends of the first work roll 24 and the intermediate roll(s) 27 (and 28) are tapered forming contact surfaces 47 and 48 with the rings 21 and 22. The inner surfaces of the rings 21 and 22 are tapered correspondingly. When the rings 21 and 22 are moved further apart the gap G between the work rolls 24 and 25 is increased and when the rings are moved towards each other the gap is diminished. The movement of the rings 21 and 22 is described with an arrow 49.

With the above-described embodiments of the invention the rolling mill frame structure can be made significantly smaller. This is due the smaller bearings needed for the rolls in the rolling mill.

While the invention has been described with reference to its preferred embodiments, it is to be understood that modifications and variations will occur to those skilled in the art.

Such modifications and variations are intended to fall within the scope of the appended claims.

The invention claimed is:

1. An apparatus for rolling a strip comprising a first work roll, which is mounted from both ends with bearings to a mill frame, a second work roll, the first and second work rolls forming a nip in between them, one ring closing inside the first and second work rolls, at least one first intermediate roll mounted to the mill frame from both ends with bearings and arranged in rolling contact and between the second work roll and inside surface of the ring, wherein the first work roll and the at least one first intermediate roll are tapered at both ends and the inside surface of the ring is also tapered accordingly.

2. An apparatus according to claim 1 wherein the apparatus further comprises a second intermediate roll mounted to the mill frame from both ends with bearings and arranged in rolling contact and between the second work roll and the inside surface of the ring.

3. An apparatus according to claim 1 wherein the apparatus further comprises a stationary frame arranged to cover the outside surface of the ring and where in between the frame and the ring are arranged a bearing assembly.

4. An apparatus according to claim 1 wherein the surfaces of the first and second work rolls, the intermediate roll(s) and the inside surface of the ring are essentially flat and parallel to the rolling axis of the ring.

5. An apparatus for rolling a strip comprising a first work roll, which is mounted from both ends with bearings to a mill frame, a second work roll, the first and second work rolls forming a nip in between them, at least two rings closing inside at least the first work roll at the opposite ends of the roll, at least one first intermediate roll mounted to the mill frame from both ends with bearings and arranged in rolling contact and between the second work roll and inside surfaces of the rings, wherein the first work roll and the at least one first intermediate roll are tapered at both ends and the inside surfaces of the at least two rings are also tapered accordingly.

6. An apparatus according to claim 5 wherein the apparatus further comprises a second intermediate roll mounted to the mill frame from both ends with bearings and arranged in rolling contact and between the second work roll and the inside surfaces of the rings.

7. An apparatus according to claim 5 wherein the apparatus further comprises a stationary frame arranged to cover the outside surfaces of the rings and where in between the frame and the rings are arranged a bearing assembly.

8. An apparatus according to claim 5 wherein the surfaces of the first and second work rolls, the intermediate roll(s) and the inside surfaces of the rings are essentially flat and parallel to the rolling axes of the rings.

9. An apparatus for rolling a strip comprising a first work roll, which is mounted from both ends with bearings to a mill frame, a second work roll, the first and second work rolls forming a nip in between them, at least two rings closing inside at least the first work roll at the opposite ends of the roll, at least one first intermediate roll mounted to the mill frame from both ends with bearings and arranged in rolling contact and between the second work roll and inside surfaces of the rings wherein the at least two rings have inside surfaces and wherein the first work roll and the at least one first intermediate roll are tapered at both ends and the inside surfaces of the at least two rings are also tapered accordingly.

10. A method for rolling a strip comprising the steps of:

mounting a first work roll from both ends to a mill frame with bearings;

arranging a second work roll so that the first and second work rolls form a nip in between;

arranging one ring to close inside the work rolls;

arranging a first intermediate roll mounted from both ends to the mill frame in rolling contact with the second work roll and the inside surface of the ring; and directing the strip to the nip, wherein the first work roll and the first intermediate roll are tapered at both ends and the inside surface of the ring is also tapered accordingly.

11. A method according to claim 10 wherein the method further comprises the step of:

arranging a second intermediate roll between the second work roll and the inside surface of the ring and mounting the second intermediate roll from both ends to the mill frame with bearings.

12. A method for rolling a strip comprising the steps of:

mounting a first work roll from both ends to the mill frame with bearings;

arranging a second work roll so that the first and second work rolls form a nip in between;

arranging at least two rings to close inside at least the first work roll;

arranging a first intermediate roll mounted from both ends to the mill frame in rolling contact with the second work roll and the inside surfaces of the rings; and directing the strip to the nip, wherein the first work roll and the at least one first intermediate roll are tapered at both ends and the inside surfaces of the at least two rings are also tapered accordingly.

13. A method according to claim 12 wherein the method further comprises the step of:

arranging a second intermediate roll between the second work roll and the inside surfaces of the rings and mounting the second intermediate roll from both ends to the mill frame with bearings.

14. A method according to claim 10 wherein the adjustment of the gap in the nip is done by moving one of the intermediate rolls.

15. A method according to claim 11 wherein the adjustment of the gap in the nip is done by moving both intermediate rolls into the opposite directions or into the same direction.

16. A method according to claim 10 wherein the adjustment of the gap in the nip is done by moving the second work roll in relation to the line drawn between the rolling axes of the first work roll and the first intermediate roll.

17. A method for rolling a strip comprising the steps of:

mounting a first work roll from both ends to the mill frame with bearings;

arranging a second work roll so that the first and second work rolls form a nip in between;

arranging at least two rings to close inside at least the first work roll;

arranging a first intermediate roll mounted from both ends to the mill frame in rolling contact with the second work roll and the inside surfaces of the rings; and directing the strip to the nip, wherein the at least two rings have inside surfaces and wherein the first work roll and the first intermediate roll are tapered at both ends and the inside surfaces of the at least two rings are tapered accordingly so that the adjustment of a gap in the nip is done by changing a distance between the rings.

18. A method according to claim 10 wherein the method further comprises the step of:

covering the ring(s) with a stationary frame and arranging a bearing assembly between the stationary frame and the ring(s).

* * * * *